US007964544B2

(12) United States Patent
Smith et al.

(10) Patent No.: US 7,964,544 B2
(45) Date of Patent: Jun. 21, 2011

(54) CLEANING COMPOSITION AND METHOD FOR PREPARING A CLEANING COMPOSITION

(75) Inventors: Kim R. Smith, Woodbury, MN (US); Keith E. Olson, Apple Valley, MN (US); Tami J. Tadrowski, Greensboro, NC (US)

(73) Assignee: Ecolab USA Inc., St. Paul, MN (US)

( * ) Notice: Subject to any disclaimer, the term of this patent is extended or adjusted under 35 U.S.C. 154(b) by 910 days.

(21) Appl. No.: 11/264,820

(22) Filed: Oct. 31, 2005

(65) Prior Publication Data

US 2007/0099807 A1 May 3, 2007

(51) Int. Cl.

| | |
|---|---|
| ***C11D 17/00*** | (2006.01) |
| ***C11D 1/722*** | (2006.01) |
| ***C11D 3/37*** | (2006.01) |
| ***C11D 17/04*** | (2006.01) |
| ***C11D 17/06*** | (2006.01) |

(52) U.S. Cl. ..... 510/108; 510/181; 510/214; 510/238; 510/243; 510/245; 510/421; 510/434; 510/438; 510/439; 510/445; 510/446; 510/476

(58) Field of Classification Search ..... 510/421, 510/181, 238, 434, 470, 477, 214, 243, 245, 510/438, 439, 445, 446, 476, 108
See application file for complete search history.

(56) References Cited

U.S. PATENT DOCUMENTS

| | | | | |
|---|---|---|---|---|
| 3,695,989 | A | 10/1972 | Albert | |
| 4,260,528 | A | 4/1981 | Fox et al. | |
| 4,289,815 | A | 9/1981 | Lee | |
| 4,348,293 | A | 9/1982 | Clarke et al. | |
| 4,416,793 | A | 11/1983 | Barrat et al. | |
| 4,474,976 | A | 10/1984 | Faltynek | |
| 4,608,187 | A | 8/1986 | Chang | |
| 4,670,171 | A | 6/1987 | Magyar | |
| 4,678,596 | A * | 7/1987 | Dupre et al. | 510/514 |
| 4,692,494 | A | 9/1987 | Sonenstein | |
| 4,783,340 | A | 11/1988 | McDonell et al. | |
| 4,861,511 | A * | 8/1989 | Kaplan | 510/193 |
| 4,883,828 | A | 11/1989 | Oakes et al. | |
| 4,908,381 | A | 3/1990 | Greenwald et al. | |
| 4,921,629 | A | 5/1990 | Malihi et al. | |
| 4,938,888 | A * | 7/1990 | Kiefer et al. | 510/295 |
| 4,999,386 | A | 3/1991 | Oakes et al. | |
| 5,030,374 | A * | 7/1991 | Tranner | 510/137 |
| 5,049,303 | A * | 9/1991 | Secemski et al. | 510/356 |
| 5,061,485 | A | 10/1991 | Oakes et al. | |
| 5,094,770 | A | 3/1992 | Sheridan et al. | |
| 5,108,740 | A | 4/1992 | Greenwald et al. | |
| 5,154,920 | A | 10/1992 | Flesher et al. | |
| 5,273,677 | A | 12/1993 | Arif | |
| 5,352,376 | A | 10/1994 | Gutzmann | |
| 5,437,807 | A | 8/1995 | Garabedian, Jr. et al. | |
| 5,444,094 | A | 8/1995 | Malik et al. | |
| 5,447,648 | A | 9/1995 | Steindorf | |
| 5,468,423 | A | 11/1995 | Garabedian, Jr. et al. | |
| 5,486,307 | A | 1/1996 | Misselyn et al. | |
| 5,501,815 | A | 3/1996 | Man | |
| 5,516,452 | A | 5/1996 | Welch et al. | |
| 5,534,198 | A | 7/1996 | Masters et al. | |
| 5,534,199 | A | 7/1996 | Winkler, III | |
| 5,545,352 | A | 8/1996 | Pike | |
| 5,552,079 | A | 9/1996 | Roach et al. | |
| 5,589,099 | A | 12/1996 | Baum | |
| 5,602,093 | A | 2/1997 | Haerer et al. | |
| 5,712,244 | A | 1/1998 | Addison et al. | |
| 5,739,099 | A | 4/1998 | Welch et al. | |
| 5,750,482 | A | 5/1998 | Cummings | |
| 5,798,324 | A | 8/1998 | Svoboda | |
| 5,849,681 | A | 12/1998 | Neumiller et al. | |
| 5,866,524 | A | 2/1999 | Wevers | |
| 5,880,088 | A | 3/1999 | Lentsch et al. | |
| 5,888,954 | A * | 3/1999 | Haerer et al. | 510/226 |
| 5,906,992 | A | 5/1999 | Fonsny et al. | |
| 5,919,471 | A | 7/1999 | Saferstein et al. | |
| 6,053,364 | A | 4/2000 | Van der heijden | |
| 6,096,702 | A | 8/2000 | Ramirez et al. | |
| 6,103,644 | A | 8/2000 | Sheridan | |
| 6,194,371 | B1 * | 2/2001 | Donovan et al. | 510/396 |
| 6,228,825 | B1 | 5/2001 | Gorlin et al. | |
| 6,235,692 | B1 | 5/2001 | Scoville et al. | |
| 6,250,511 | B1 | 6/2001 | Kelly | |
| 6,303,553 | B1 | 10/2001 | Gorlin | |
| D452,653 | S | 1/2002 | Boshuizen et al. | |

(Continued)

FOREIGN PATENT DOCUMENTS

| | | | |
|---|---|---|---|
| EP | 0 595 590 | A2 | 5/1994 |
| EP | 0 630 965 | A1 | 12/1994 |
| GB | 2 311 537 | A | 10/1997 |
| JP | 10001790 | A | 1/1998 |
| WO | WO 94/14942 | | 7/1994 |
| WO | WO 96/08553 | | 3/1996 |
| WO | WO 96/10068 | | 4/1996 |
| WO | WO 97/25408 | | 7/1997 |
| WO | WO 98/44080 | | 10/1998 |
| WO | WO 00/39268 | | 7/2000 |
| WO | WO 02/12422 | A1 | 2/2002 |
| WO | WO 02/055641 | A1 | 7/2002 |

*Primary Examiner* — Lorna M Douyon

(74) *Attorney, Agent, or Firm* — Andrew D. Sorensen; Laura C. DiLorenzo; Amy J. Hoffman

(57) ABSTRACT

A cleaning composition concentrate includes about 0.05 wt. % to about 90 wt. % of a surfactant component, about 0.01 wt. % to about 20 wt. % of a dispersant component, and about 0.001 wt. % to about 15 wt. % of a sheeting agent component, wherein the composition comprises less than about 0.1 wt. % volatile organic compound exhibiting a vapor pressure of less than 0.1 mm Hg at 20° C. The cleaning composition can be provided as a use composition as a result of diluting the cleaning composition concentrate with water of dilution at a dilution ratio of cleaning composition concentrate to water of dilution of about 1:1. A method for preparing a cleaning composition is disclosed.

21 Claims, No Drawings

U.S. PATENT DOCUMENTS

| | | | | |
|---|---|---|---|---|
| D452,822 | S | 1/2002 | Boshuizen et al. | |
| D456,260 | S | 4/2002 | Boshuizen et al. | |
| 6,420,326 | B1 | 7/2002 | Maile et al. | |
| 6,475,977 | B1 | 11/2002 | Pfeiffer et al. | |
| 6,503,879 | B2 | 1/2003 | Lentsch et al. | |
| 6,532,973 | B1 * | 3/2003 | Gross et al. | 134/25.2 |
| 6,613,732 | B2 | 9/2003 | Suazon et al. | |
| 6,616,641 | B2 | 9/2003 | Sheridan | |
| 6,632,785 | B2 | 10/2003 | Pfeiffer et al. | |
| 6,673,760 | B1 | 1/2004 | Lentsch et al. | |
| 6,701,940 | B2 * | 3/2004 | Tsibouklis et al. | 134/25.2 |
| 6,716,805 | B1 | 4/2004 | Sherry et al. | |
| 6,784,148 | B2 * | 8/2004 | Tadrowski et al. | 510/197 |
| 6,786,223 | B2 | 9/2004 | Klinkhammer et al. | |
| 6,881,711 | B1 | 4/2005 | Gershun et al. | |
| 7,056,874 | B2 * | 6/2006 | Tadrowski et al. | 510/197 |
| 7,592,301 | B2 * | 9/2009 | Smith et al. | 510/180 |
| 2002/0072481 | A1 | 6/2002 | Hubert et al. | |
| 2002/0107166 | A1 * | 8/2002 | Morris et al. | 510/421 |
| 2003/0104750 | A1 | 6/2003 | Kelly | |
| 2003/0119704 | A1 * | 6/2003 | Morris et al. | 510/421 |
| 2003/0162678 | A1 | 8/2003 | Ashton et al. | |
| 2004/0136940 | A1 * | 7/2004 | Lazarowitz | 424/70.13 |
| 2004/0154640 | A1 * | 8/2004 | Smith et al. | 134/2 |
| 2005/0003990 | A1 * | 1/2005 | Smith et al. | 510/421 |
| 2005/0106223 | A1 | 5/2005 | Kelly | |
| 2005/0106979 | A1 | 5/2005 | Scheubel et al. | |
| 2005/0159088 | A1 | 7/2005 | Smith | |
| 2006/0089285 | A1 * | 4/2006 | Ahmed et al. | 510/370 |
| 2006/0135394 | A1 * | 6/2006 | Smith et al. | 510/424 |

* cited by examiner

CLEANING COMPOSITION AND METHOD FOR PREPARING A CLEANING COMPOSITION

FIELD OF THE INVENTION

The invention relates to a cleaning composition and methods for preparing a cleaning composition. In particular, the cleaning composition can be used to clean hard surfaces and can be provided substantially free of volatile organic compounds.

BACKGROUND OF THE INVENTION

Hard surface cleaners are commonly available for general purpose cleaning of relatively hard and impermeable surfaces. Various surfaces that can be cleaned using hard surface cleaners include plastic, ceramic, vitreous, and metal surfaces. Hard surface cleaners are often used to clean surfaces having a shiny finish, such as tiles, washbowls, toilets, bathtubs, walls, floors, painted and washable wallpapered surfaces, etc. Exemplary disclosures of hard surface cleaners include U.S. Pat. No. 6,881,711 to Gershun et al., U.S. Pat. No. 6,786,223 to Klinkhammer et al., U.S. Pat. No. 6,716,805 to Sherry et al., U.S. Pat. No. 5,468,423 to Garabedian, Jr. et al., and U.S. Pat. No. 5,437,807 to Garabedian, Jr. et al.

Glass can be considered a type of hard surface. Glass cleaners, however, are often formulated to account for the desired transparency of glass when used, for example, as windows and mirrors. Glass cleaners are often available in a form that is ready to use. A consumer will purchase a glass cleaner, such as a window cleaner, and use the glass cleaner directly on a glass surface. Exemplary disclosures of glass cleaner compositions include U.S. Pat. No. 6,420,326 to Maile et al., U.S. Pat. No. 5,534,198 to Masters et al., U.S. Pat. No. 5,750,482 to Cummings, U.S. Pat. No. 5,798,324 to Svoboda, and U.S. Pat. No. 5,849,681 to Newmiller.

Hard surface cleaners and glass cleaners often include volatile organic compounds (VOCs). Volatile organic compounds include those compounds exhibiting a vapor pressure of less than 0.1 mm Hg at 20° C. Because of the environmentally harmful effects of volatile organic compounds, there is a desire to provide cleaning compositions that minimize the use of volatile organic compounds.

SUMMARY

A cleaning composition concentrate is provided according to the invention. The cleaning composition concentrate comprises about 0.05 wt. % to about 90 wt. % of a surfactant component, about 0.01 wt. % to about 20 wt. % of a dispersant component, and about 0.001 wt. % to about 15 wt. % of a sheeting agent component, wherein the composition comprises less than about 0.1 wt. % volatile organic compound exhibiting a vapor pressure of less than 0.1 mm Hg at 20° C.

A cleaning composition is provided according to the invention where the cleaning composition is a result of diluting the cleaning composition concentrate. The cleaning composition concentrate can be diluted with water of dilution at a dilution ratio of the concentrate to the water of dilution of at least about 1:1. The dilution ratio can be provided up to about 1:1000. In many applications where a unit dose of the cleaning composition concentrate is used to provide a cleaning composition use composition having a volume of about 6 ounces to about one gallon, the dilution ratio can be about 1:2 to about 1:100.

A method of forming a cleaning composition is provided according to the invention. The method includes a step of mixing a cleaning composition concentrate and water of dilution at a weight ratio of the cleaning composition concentrate to the water of dilution of at least about 1:2. The dilution ratio can be up to about 1:1000. A preferred dilution ratio can be about 1:1 to about 1:100 when diluting a unit dose of the cleaning composition concentrate to form the cleaning composition use composition having a volume of about 6 ounces to about one gallon.

DETAILED DESCRIPTION OF THE INVENTION

The cleaning composition can be used as a hard surface cleaner. Hard surfaces that can be cleaned using a hard surface cleaner include glass, plastic, ceramic, vitreous, and metal surfaces. Exemplary hard surfaces include those having a shiny finish, such as tiles, washbowls, toilets, bathtubs, showers, walls, floors, painted and washable wallpapered surfaces, etc. Glass surfaces often include windows and mirrors. A hard surface cleaner for use on glass can be referred to as a glass cleaner. Several hard surfaces can be referred to as "automotive surfaces" and include windshields, fenders, tires, doors, roof, hood, trunk, bumper, trim, windows, hubcaps, and vehicle body. Various vehicles that can include such automotive surfaces include automobiles, trucks, trains, motorcycles, airplanes, and boats.

The cleaning composition can be referred to as a detergent composition and can be provided in the form of a concentrated composition or a ready to use composition. The concentrated composition can be referred to more simply as the concentrate, and can be diluted to provide the ready to use composition. The ready to use composition can be referred to as the use composition when it is the composition that is intended to be applied directly to a surface to be cleaned. In the case of a glass cleaner, the ready to use composition can be applied to a glass surface and wiped off to remove soil. For various other types of hard surface cleaners, it may be desirable to apply the cleaning composition directly to the hard surface to be cleaned or to dilute the cleaning composition by, for example, pouring the cleaning composition into a container of water and then using the diluted cleaning composition as a use composition for cleaning the hard surface.

The cleaning composition can be provided as a concentrate for shipment to retail distributors, commercial end users, or consumers. Retail distributors, commercial end users, and consumers can dilute the concentrate to provide a less concentrated detergent composition or a ready to use detergent composition. Retail distributors can package and sell the less concentrated detergent composition or the ready to use composition to consumers. For example, a retail distributor can dilute a concentrate and then sell the diluted concentrate as a ready to use glass cleaner or a ready to use hard surface cleaner. In addition, commercial end users, such as car washing facilities and janitorial services, can dilute the concentrate to provide a ready to use composition and then use the ready to use composition as part of their cleaning service. Consumers can dilute the concentrate to provide a ready to use composition.

By providing the cleaning composition as a concentrate, the concentrate can be diluted with water available at the locale or site of dilution. It is recognized that the level of water hardness often changes from one locale to another. Accordingly, the concentrate can be formulated to handle the varying amounts of hardness that can change depending upon the water used for dilution at the locale or site of dilution. In general, water hardness refers to the presence of calcium, magnesium, iron, manganese, and other polyvalent metal cations that may be present in the water, and it is understood that the level of water hardness found in water may vary from municipality to municipality. The concentrate can be formulated to handle differing water hardness levels found in varying locations without having to soften the water or remove the hardness from the water. High solids containing water is considered to be water having a total dissolved solids (TDS) content in excess of 200 ppm. In certain localities, the water can contain a total dissolved solids content in excess of 400 ppm, and even in excess of 800 ppm. Water hardness can be characterized by the unit "grain" where one grain water hardness is equivalent to 17.1 ppm hardness expressed as $CaCO_3$. Hard water can be characterized as having at least 1 grain hardness. Hard water is commonly available having at least 5 grains hardness, at least 10 grains hardness, and at least 20 grains hardness.

The hardness in water can cause anionic surfactants to precipitate. Visual precipitation refers to precipitate formation that can be observed by the naked eye without visual magnification or enhancement. In order to protect the anionic surfactant component in the cleaning composition of the invention, a water hardness anti-precipitant mixture can be provided that includes a dispersant and at least one of a sheeting agent and a humectant. The cleaning composition can include additional surfactants and other components commonly found in cleaning compositions.

The concentrate can be provided in various forms including liquid form, gel form, and solid form. Exemplary solid forms include powders, granules, tablets, pellets, and blocks. The concentrate can be provided on a substrate. For example, the concentrate in the form of a liquid, gel, or solid can be provided on a substrate or carrier. An exemplary substrate includes a fabric such as a non-woven fabric, a woven fabric, a knitted fabric, etc. The concentrate or the concentrate on a substrate can be provided in packaging that makes it convenient to prepare a particular amount of ready to use composition. For example, the amount of the concentrate packaged in a container can be selected so that it can be combined with a predetermined amount of water to provide a desired amount of ready to use composition. By way of example, when the concentrate is provided in a solid form and it is desirable to prepare a one quart or one liter volume of ready to use composition, a single dose of concentrate can be provided having a size of about 0.1 g to about 25 g and can be provided having a size of about 1 g to about 20 g. When the concentrate is provided as a liquid or gel and it is desirable to prepare a one quart or one liter volume of ready to use composition, a single dose of the liquid or gel form concentrate can be about 5 g to about 60 g. It should be understood that these doses are provided by way of example of a convenient single dose size to prepare a six ounce to one gallon volume of ready to use composition (preferably, a one quart to one liter volume of ready to use composition). Accordingly, the single dose can be dropped into a quart or liter bottle containing water and allowed to form the ready to use composition. It should be understood that the single dose size can be varied to accommodate the desired ready to use composition volume. For example, if it is desired to produce a larger volume of ready to use composition, multiple doses can be combined or a larger single dose can be prepared and used to generate the larger volume ready to use composition.

The concentrate can be provided in packaging that separates doses of the concentrate. Such packaging can be referred to as multi-dose packaging. An example of multi-dose packaging includes a blister pack where pellets or tablets can be packaged separately and removed individually from the blister pack. When it is desirable to prepare a particular volume of ready to use composition, a dose can be removed from the packaging and introduced into a volume of water to form the desired volume of ready to use composition.

The concentrate can be packaged in a film or container as individual dose amounts to prepare a desired volume of ready to use composition, or can be packaged as a larger volume where desired amounts of the concentrate can be removed by, for example, degradation, or erosion, to prepare a desired volume of ready to use composition. For example, a stream of water can be applied against a block of the concentrate resulting in the degradation or erosion of the block, and the resulting water can be used to prepare a ready to use composition.

The packaging or film can be ruptured or opened to allow removal of the concentrate. An exemplary type of packaging or film that can be used includes a water-soluble or water dispersible film.

The packaging material can be provided as a water soluble packaging material such as a water soluble packaging film. Exemplary water soluble packaging films are disclosed in U.S. Pat. Nos. 6,503,879; 6,228,825; 6,303,553; 6,475,977; and 6,632,785, the disclosures of which are incorporated herein by reference. In addition, see U.S. Pat. No. 4,474,976 to Yang, U.S. Pat. No. 4,692,494 to Sonenstein, U.S. Pat. No. 4,608,187 to Chang, U.S. Pat. No. 4,416,793 to Haq, U.S. Pat. No. 4,348,293 to Clarke, U.S. Pat. No. 4,289,815 to Lee, and U.S. Pat. No. 3,695,989 to Albert, the disclosures of which are incorporated herein by reference. An exemplary water soluble polymer that can provide a packaging material that can be used to package the concentrate includes polyvinyl alcohol. The packaged concentrate can be provided as unit dose packages or multiple dose packages. In the case of unit dose packages, it is expected that a single packaged unit will be placed in a dishwashing machine, such as the detergent compartment of the dishwashing machine, and will be used up during a single wash cycle. In the case of a multiple dose package, it is expected that the unit will be placed in a hopper and a stream of water will degrade a surface of the concentrate to provide a liquid concentrate that will be introduced into the dishwashing machine.

Suitable water soluble polymers which may be used in the invention are described in Davidson and Sittig, *Water Soluble* Resins, Van Nostrand Reinhold Company, New York (1968), herein incorporated by reference. The water soluble polymer should have proper characteristics such as strength and pliability in order to permit machine handling. Exemplary water soluble polymers include polyvinyl alcohol, cellulose ethers, polyethylene oxide, starch, polyvinylpyrrolidone, polyacrylamide, polyvinyl methyl ether-maleic anhydride, polymaleic anhydride, styrene maleic anhydride, hydroxyethylcellulose, methylcellulose, polyethylene glycols, carboxymethylcellulose, polyacrylic acid salts, alginates, acrylamide copolymers, guar gum, casein, ethylene-maleic anhydride resin series, polyethyleneimine, ethyl hydroxyethylcellulose, ethyl methylcellulose, hydroxyethyl methylcellulose. Lower molecular weight water soluble, polyvinyl alcohol film-forming polymers are generally, preferred. Polyvinyl alcohols that can be used include those having a weight average molecular weight of between about 1,000 and about 300,000, and between about 2,000 and about 150,000, and between about 3,000 and about 100,000.

The concentrate can be provided on a substrate. For example, the concentrate provided as a powder or gel can be provided on a substrate such as a non-woven. The substrate containing the concentrate can then be removed from a packaging and added to a container of water to generate a ready to use composition.

The concentrate can be provided in a container in a premeasured amount so that it can be added with a predetermined amount of water. For example, the concentrate can be added to a bucket or other container containing a volume of water such as a gallon, a quart, a liter, or an amount of about 6 to 16 ounces of water. The concentrate and container can be dropped into a volume of water and allowed to dissolve to form a use composition. Consumers can periodically form ready to use cleaning compositions by introducing the concentrate provided in a water soluble container into a bucket or spray container. In addition, various commercial applications are available for the concentrate in a packette. For example, attendants at a gas station may periodically drop a packet containing the concentrate into a bucket or bin of water for use in window washing. In addition, janitorial services may utilize the concentrate in a packette to prepare various use compositions.

Surfactant Component

Various surfactants can be used in the cleaning composition or the surfactant component. For example, the surfactant component can include an anionic surfactant, a nonionic surfactant, a cationic surfactant, a zwitterionic, an amphoteric surfactant, or a mixture thereof.

Anionic surfactants are desirable in cleaning compositions because of their wetting and detersive properties. The anionic surfactants that can be used according to the invention include any anionic surfactant available in the cleaning industry. Exemplary groups of anionic surfactants include sulfonates and sulfates. Exemplary surfactants that can be provided in the anionic surfactant component include alkyl aryl sulfonates, secondary alkane sulfonates, alkyl methyl ester sulfonates, alpha olefin sulfonates, alkyl ether sulfates, alkyl sulfates, alcohol sulfates, or mixtures thereof.

Exemplary alkyl aryl sulfonates that can be used in the cleaning composition can have an alkyl group that contains 6 to 24 carbon atoms and the aryl group can be at least one of benzene, toluene, and xylene. An exemplary alkyl aryl sulfonate includes linear alkyl benzene sulfonate. An exemplary linear alkyl benzene sulfonate includes linear dodecyl benzyl sulfonate that can be provided as an acid that is neutralized to form the sulfonate. Additional exemplary alkyl aryl sulfonates include xylene sulfonate and cumene sulfonate.

Exemplary alkane sulfonates that can be used in the cleaning composition can have an alkane group having 6 to 24 carbon atoms. Exemplary alkane sulfonates that can be used include secondary alkane sulfonates. An exemplary secondary alkane sulfonate includes sodium $C_{14}$-$C_{17}$ secondary alkyl sulfonate commercially available as Hostapur SAS from Clariant.

Exemplary alkyl methyl ester sulfonates that can be used in the cleaning composition include those having an alkyl group containing 6 to 24 carbon atoms.

Exemplary alpha olefin sulfonates that can be used in the cleaning composition include those having alpha olefin groups containing 6 to 24 carbon atoms.

Exemplary alkyl ether sulfates that can be used in the cleaning composition include those having between about 1 and about 10 repeating alkoxy groups, between about 1 and about 5 repeating alkoxy groups. In general, the alkoxy group will contain between about 2 and about 4 carbon atoms. An exemplary alkoxy group is ethoxy. An exemplary alkyl ether sulfate is sodium lauric ether ethoxylate sulfate and is available under the name Steol CS-460.

Exemplary alkyl sulfates that can be used in the cleaning composition include those having an alkyl group containing 6 to 24 carbon atoms. Exemplary alkyl sulfates include sodium lauryl sulfate and sodium lauryl/myristyl sulfate.

Exemplary alcohol sulfates that can be used in the cleaning composition include those having an alcohol group containing about 6 to about 24 carbon atoms.

The anionic surfactant can be neutralized with an alkaline metal salt, an amine, or a mixture thereof. Exemplary alkaline metal salts include sodium, potassium, and magnesium. Exemplary amines include monoethanolamine, triethanolamine, and monoisopropanolamine. If a mixture of salts is used, an exemplary mixture of alkaline metal salt can be sodium and magnesium, and the molar ratio of sodium to magnesium can be between about 3:1 and about 1:1.

The cleaning composition, when provided as a concentrate, can include the anionic surfactant in an amount sufficient to provide a use composition having desired wetting and detersive properties. In general, the concentrate can be provided as a solid or as a liquid. When the concentrate is provided as a liquid, it can be provided in a form that is readily flowable so that it can be pumped or aspirated. It can be desirable to minimize the amount of water while preserving the flowable properties of the concentrate when it is provided as a fluid. The concentrate can contain about 0.05 wt. % to about 30 wt. % of the anionic surfactant, about 0.1 wt. % to about 25 wt. % of the anionic surfactant, and about 0.5 wt. % to about 20 wt. % of the anionic surfactant.

The cleaning composition can include a nonionic surfactant to provide detersive properties. Exemplary nonionic surfactants that can be used include alcohol alkoxylates, alkylphenol alkoxylates, alkyl amids, alkyl esters, alkyl polyglycosides, alkyl amines, or mixtures thereof. Exemplary alcohol alkoxylates include laureth-7-myristyl polypropoxylate (2PO) and octyl poly(ethoxylate-propoxylate). Exemplary alkylphenol alkoxylates include nonylphenol ethoxylate, dinonylphenol ethoxylates, and octylphenol propoxylate. Exemplary alkyl amids include cocodiethanol amid, stearylmonoethanol amid, and glyceryl amid. Exemplary alkyl esters include alkyl sorbitan ester and polyethylene glycol butyl ester. Exemplary alkyl polyglycosides include octyl polyglycoside and myristyl polyglycoside. An exemplary alkyl amine includes cocodiethanolamine.

The cleaning composition, when provided as a concentrate, can include the nonionic surfactant in an amount sufficient to provide a use solution having the desired detersive properties. The concentrate can contain about 0.05 wt. % to about 30 wt. % of the nonionic surfactant, about 0.1 wt. % to about 25 wt. % of the nonionic surfactant, and about 0.5 wt. % to about 20 wt. % of the nonionic surfactant.

The cleaning composition can include a zwitterionic or amphoteric surfactant. Exemplary amphoteric surfactants that can be included in the cleaning composition include amine oxides, betaines and their derivatives, sultaines and their derivatives, amphocarboxylates (e.g., amphoacetates, amphocarboxylates, amphopropionates and dipropionates, mamphoimidazoline derivatives, etc.), or mixtures thereof. A preferred amphoteric surfactant is a betaine.

The cleaning composition, when provided as a concentrate, can include the amphoteric surfactant in an amount sufficient to provide a use solution having the desired detersive properties. The concentrate can contain about 0.05 wt. % to about 30 wt. % of the amphoteric surfactant, about 0.1 wt. % to about 25 wt. % of the amphoteric surfactant, and about 0.5 wt. % to about 20 wt. % of the amphoteric surfactant.

The cleaning composition can include a cationic surfactant to provide desired detersive properties. Exemplary cationic surfactants that can be included in the cleaning composition include quaternary ammonium compounds, salts of amines, quaternary phosphonium compounds, quaternary sulfonium compounds, or mixtures thereof. Certain materials when used under acidic conditions may also be considered cationic surfactants. Exemplary materials include betaines, amine oxide and amines when form surface-active acid salts.

The cleaning composition, when provided as a concentrate, can include the cationic surfactant in an amount sufficient to provide a use solution having the desired detersive properties. The concentrate can contain about 0.05 wt. % to about 30 wt. % of the cationic surfactant, about 0.1 wt. % to about 25 wt. % of the cationic surfactant, and about 0.5 wt. % to about 20 wt. % of the cationic surfactant.

The concentrate can include the surfactant component (e.g., the total amount of surfactant including mixtures of surfactants) in an amount sufficient to provide the use composition with desired detersive properties. In the case of a liquid concentrate, the concentrate can include the surfactant component in an amount of about 0.05 wt. % to about 20 wt. % or in an amount of about 0.5 wt. % to about 10 wt. % wherein the concentrate contains less than 99 wt. % water. In the case of a solid concentrate such as a powder, the concentrate can include the surfactant component in an amount of about 10 wt. % to about 90 wt. %, or about 20 wt. % to about 80 wt. % wherein the concentrate contains less than about 30 wt. % water and can contain no water or substantially no water. It should be understood that in the case of a solid, the ranges of the surfactant component apply to individual surfactant types (e.g., anionic surfactant, nonionic surfactant, etc.) as well as to the total amount of surfactant.

Dispersant Component

The cleaning composition can include a dispersant component to help handle the hardness found in water. Dispersants that can be used according to the invention include those that are referred to as "lime soap dispersants." In general, dispersants can include those components that have a tendency to interfere with precipitation of anionic surfactants caused by water hardness.

Dispersants that can be used according to the invention can include a polymer containing pendant carboxylic acid groups and/or pendant carboxylic acid salt groups, an oligomer containing pendant carboxylic acid groups and/or pendant carboxylic acid salt groups, or a mixture thereof. It should be understood that the term "pendant" refers to the groups being present other than in the polymer backbone and/or oligomer backbone. The dispersants can be available as homopolymers or co-polymers or as homoligomers or co-oligomers. Exemplary dispersants include poly(acrylic acid), poly (acrylic acid/maleic acid) co-polymers, poly(maleic acid/olefin) co-polymers, phosphino carboxylated polymers, and mixtures thereof. The dispersants can be soluble or dispersible in the concentrate and can be a component that does not significantly increase the viscosity of the concentrate or of the use solution relative to its absence. The dispersant can be a homopolymer or co-polymer, and can have a molecular weight range of about 300 to about 5,000,000, and can have a molecular weight range of about 2,000 to about 2,000,000, and can have a molecular weight range of about 3,000, to about 500,000. The dispersant can include repeating units based upon acrylic acid, maleic acid, polyols, olefins, and mixtures thereof. An exemplary dispersant is a maleic anhydride/olefin co-polymer. An exemplary maleic anhydride/olefin co-polymer is available from Rohm & Haas under the name of Acusol 460N. An exemplary polyacrylic acid sodium salt having a molecular weight of about 4,500 is available from Rohm & Haas under the name Acusol 434N. An exemplary acrylic acid/maleic acid co-polymer having a molecular weight of about 3,200 is available from Rohm & Haas under the Acusol 448. An exemplary acrylic acid/maleic acid sodium salt having a molecular weight of about 70,000 is available from Rohm & Haas under the name Acusol 479N. An exemplary acrylic acid/maleic acid sodium salt having a molecular weight of about 40,000 is available from Rohm & Haas under the name Acusol 505N. In general, if the dispersant is provided as an acid, its pH may be adjusted to neutral or alkaline. The pH adjustment may be provided prior to forming the concentrate or during the formation of the concentrate. In addition, the pH adjustment may occur at any time prior to or during dilution with the water of dilution to provide the use solution.

The dispersant can be provided in the concentrate in an amount sufficient, when taken in consideration of the amount of sheeting agent and/or humectant, to provide resistance to precipitation of the anionic surfactant component when diluted with hard water. In general, the concentrate can contain between about 0.01 wt. % and about 20 wt. % dispersant, between about 0.1 wt. % and about 15 wt. % dispersant, and between about 0.5 wt. % and about 5 wt. % dispersant.

Sheeting Agent Component

The sheeting agent component can include a surfactant that, when combined with the dispersant component, creates a resistance to precipitation of the anionic surfactant component in the presence of hard water.

Exemplary sheeting agents that can be used according to the invention include surfactant including nonionic block copolymers, alcohol alkoxylates, alkyl polyglycosides, zwitterionics, anionics, or mixtures thereof. Additional exemplary sheeting agents include alcohol ethoxylates; alcohol propoxylates; alkylphenol ethoxylate-propoxylates; alkoxylated derivatives of carboxylic acids, amines, amids and esters; and ethylene oxide-propylene oxide copolymers. Exemplary ethylene oxide-propylene oxide polymers include those available under the name Pluronic, Pluronic R, Tetronic, and Tetronic R from BASF.

Exemplary nonionic block copolymer surfactants include polyoxyethylene-polyoxypropylene block copolymers. Exemplary polyoxyethylene-polyoxypropylene block copolymers that can be used have the formulae:

$$(EO)_x(PO)_y(EO)_x$$

$$(PO)_y(EO)_x(Po)_y$$

$$(PO)_y(EO)_x(PO)_y(EO)_x(PO)_y$$

wherein EO represents an ethylene oxide group, PO represents a propylene oxide group, and x and y reflect the average molecular proportion of each alkylene oxide monomer in the overall block copolymer composition. Preferably, x is from about 10 to about 130, y is about 15 to about 70, and x plus y is about 25 to about 200. It should be understood that each x and y in a molecule can be different. The total polyoxyethylene component of the block copolymer is preferably at least about 20 mol-% of the block copolymer and more preferably at least about 30 mol-% of the block copolymer. The material preferably has a molecular weight greater than about 1,500 and more preferably greater than about 2,000. Although the exemplary polyoxyethylene-polyoxypropylene block copolymer structures provided above have 3 blocks and 5 blocks, it should be appreciated that the nonionic block copolymer surfactants according to the invention can include more or less than 3 and 5 blocks. In addition, the nonionic block copolymer surfactants can include additional repeating units such as butylene oxide repeating units. Furthermore, the nonionic block copolymer surfactants that can be used according to the invention can be characterized heteric polyoxyethylene-polyoxypropylene block copolymers. Exemplary sheeting agents that can be used according to the invention are available from BASF under the name Pluronic, and an exemplary EO-PO co-polymer that can be used according to the invention is available under the name Pluronic N3.

A desirable characteristic of the nonionic block copolymers is the cloud point of the material. The cloud point of nonionic surfactant of this class is defined as the temperature at which a 1 wt-% aqueous solution of the surfactant turns cloudy when it is heated. BASF, a major producer of nonionic block copolymers in the United States recommends that rinse agents be formulated from nonionic EO-PO sheeting agents having both a low molecular weight (less than about 5,000) and having a cloud point of a 1 wt-% aqueous solution less than the typical temperature of the aqueous rinse. It is believed that one skilled in the art would understand that a nonionic surfactant with a high cloud point or high molecular weight would either produce unacceptable foaming levels or fail to provide adequate sheeting capacity in a rinse aid composition.

The alcohol alkoxylate surfactants that can be used as sheeting agents according to the invention can have the formula:

$$R(AO)_x—X$$

wherein R is an alkyl group containing 6 to 24 carbon atoms, AO is an alkylene oxide group containing 2 to 12 carbon atoms, x is 1 to 20, and X is hydrogen or an alkyl or aryl group containing 1-12 carbon atoms. The alkylene oxide group is preferably ethylene oxide, propylene oxide, butylene oxide, or mixture thereof. In addition, the alkylene oxide group can include a decylene oxide group as a cap.

The alkyl polyglycoside surfactants that can be used as sheeting agents according to the invention can have the formula:

$$(G)_x—O—R$$

wherein G is a moiety derived from reducing saccharide containing 5 or 6 carbon atoms, e.g., pentose or hexose, R is a fatty aliphatic group containing 6 to 24 carbon atoms, and x is the degree of polymerization (DP) of the polyglycoside representing the number of monosaccharide repeating units in the polyglycoside. The value of x can be between about 0.5 and about 10. R can contain 10-16 carbon atoms and x can be 0.5 to 3.

The zwitterionic surfactants that can be used as sheeting agents according to the invention include β-N-alkylaminopropionates, N-alkyl-β-iminodipropionates, imidazoline carboxylates, N-alkylbetaines, sulfobetaines, sultaines, amine oxides and polybetaine polysiloxanes. Preferred polybetaine polysiloxanes have the formula:

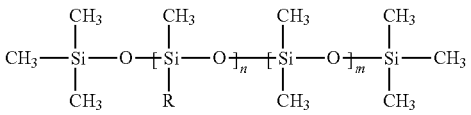

wherein R is

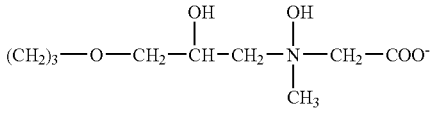

n is 1 to 100 and m is 0 to 100, preferably 1 to 100. Preferred polybetaine polysiloxanes are available under the name ABIL® from Goldschmidt Chemical Corp. Preferred amine oxides that can be used include alkyl dimethyl amine oxides containing alkyl groups containing 6 to 24 carbon atoms. A preferred amine oxide is lauryl dimethylamine oxide.

The anionic surfactants that can be used as sheeting agents according to the invention include carboxylic acid salts, sulfonic acid salts, sulfuric acid ester salts, phosphoric and polyphosphoric acid esters, perfluorinated anionics, and mixtures thereof. Exemplary carboxylic acid salts include sodium and potassium salts of straight chain fatty acids, sodium and potassium salts of coconut oil fatty acids, sodium and potassium salts of tall oil acids, amine salts, sarcosides, and acylated polypeptides. Exemplary sulfonic acid salts include linear alkylbenzenesulfonates, $C_{13}$-$C_{15}$ alkylbenzenesulfonates, benzene cumenesulfonates, toluene cumenesulfonates, xylene cumenesulfonates, ligninsulfonates, petroleum sulfonates, N-acyl-n-alkyltaurates, paraffin sulfonates, secondary n-alkanesulfonates, alpha-olefin sulfonates, sulfosuccinate esters, alkylnaphthalenesulfonates, and isethionates. Exemplary sulfuric acid ester salts include sulfated linear primary alcohols, sulfated polyoxyethylenated straight-chain alcohols, and sulfated triglyceride oils.

Exemplary surfactants which can be used as sheeting agents according to the invention are disclosed in Rosen, Surfactants and Interfacial Phenomena, second edition, John Wiley & sons, 1989, the entire document being incorporated herein by reference.

The cleaning composition can include the sheeting agent in an amount sufficient to provide the ready to use composition or the use composition with desired sheeting properties. In general, the concentrate can contain about 0.001 wt. % to about 20 wt. % of the sheeting agent, about 0.05 wt. % to about 10 wt. % of the sheeting agent, and about 0.1 wt. % to about 5 wt. % of the sheeting agent.

Humectant Component

The cleaning composition can include a humectant. It should be understood that the humectant is an optional component and the cleaning composition can be provided without the humectant component. Humectants that can be used according to the invention include those substances that exhibit an affinity for water and help enhance the absorption of water onto a substrate. If the humectant is used in the absence of a sheeting agent, the humectant should be capable of cooperating with the dispersant to resist precipitation of the anionic surfactant in the presence of hard water. Exemplary humectants that can be used according to the invention include glycerine, glycols (e.g., propylene glycol and oligomers of alkylene glycol such as dipropylene glycol and polyethylene glycol wherein the oligomers remain as a liquid at room temperature), sugars (e.g. sucrose and glucose), sorbitol, alkyl polyglycosides, polybetaine polysiloxanes, or mixtures thereof. The alkyl polyglycosides and polybetaine polysiloxanes that can be used as humectants include those described previously as sheeting agents.

The concentrate can include the humectant in an amount that cooperates with the dispersant to resist precipitation of the anionic surfactant by hard water. The concentrate can contain about 0.001 wt. % to about 20 wt. % of the humectant, about 0.05 wt. % to about 10 wt. % of the humectant, and about 0.1 wt. % to about 5 wt. % of the humectant.

When the humectant is incorporated into the cleaning composition, it can be used in an amount based upon the amount of sheeting agent used. For example, the weight ratio of humectant to sheeting agent can be greater than 1:3, and can be provided at about 5:1 to about 1:3. It should be appreciated that the characterization of the weight ratio of humectant to sheeting agent indicates that the lowest amount of humectant to sheeting agent is 1:3, and that more humectant relative to the same amount of sheeting agent can be used. The weight ratio of humectant to sheeting agent can be about 4:1 to about 1:2, and can be about 3:1 to about 1:1.

It is understood that certain components that are characterized as humectants have been used in prior compositions as, for example, processing aids, hydrotropes, solvents, and auxiliary components. In those circumstances, it is believed that the component has not been used in an amount or an in environment that provides for reducing water solids filming in the presence of high solids containing water. The use of humectants in a rinse agent composition is described in U.S. application Ser. No. 09/606,290 that was filed with the United States Patent and Trademark Office on Jun. 29, 2000, now U.S. Pat. No. 6,673,760, the entire disclosure of which is incorporated herein by reference.

It is believed that the combination of the dispersant and the sheeting agent and/or the humectant can provide stability from precipitation at temperatures down to about 40° F., and at temperatures down to freezing.

The amounts of dispersant and at least one of sheeting agent or humectant provided in the cleaning composition can be controlled to handle the water hardness levels expected from various localities as a result of the dilution of the concentrate to a use solution. In general, it is expected that the weight ratio of the dispersant to the total sheeting agent and/or humectant can be about 1:75 to about 75:1, about 1:30 to about 30:1, about 1:25 to about 25:1, about 1:15 to about 15:1; about 1:10 to about 10:1, and about 1:5 to about 5:1.

The Chelant Component

The cleaning composition according to the invention can include complexing or chelating agents that aid in reducing the harmful effects of hardness components in service water. Typically, calcium, magnesium, iron, manganese, or other polyvalent metal cations, present in service water, can interfere with the action of cleaning compositions. A chelating agent can be provided for complexing with the metal cation and preventing the complexed metal cation from interfering with the action of an active component of the rinse agent. Both organic and inorganic chelating agents are common. Inorganic chelating agents include such compounds as sodium pyrophosphate, and sodium tripolyphosphate. Organic chelating agents include both polymeric and small molecule chelating agents. Polymeric chelating agents commonly comprise ionomer compositions such as polyacrylic acids compounds. Small molecule organic chelating agents include amino-carboxylates such as salts of ethylenediaminetetracetic acid (EDTA) and hydroxyethylenediaminetetracetic acid, nitrilotriacetic acid, ethylenediaminetetrapropionates, triethylenetetraminehexacetates, and the respective alkali metal ammonium and substituted ammonium salts thereof. Phosphonates are also suitable for use as chelating agents in the composition of the invention and include ethylenediamine tetra(methylenephosphonate), nitrilotrismethylenephosphonate, diethylenetriaminepenta(methylene phosphonate), hydroxyethylidene diphosphonate, and 2-phosphonobutane-1,2,4-tricarboxylic acid. Preferred chelating agents include the phosphonates amino-carboxylates. These phosphonates commonly contain alkyl or alkylene groups with less than 8 carbon atoms.

It should be understood that the concentrate can be provided without a component conventionally characterized as a builder, a chelating agent, or a sequestrant. Nevertheless, it is believed that these components can advantageously be incorporated into the cleaning composition. It is expected that their presence would not be provided in an amount sufficient to handle the hardness in the water resulting from the water of dilution mixing with the concentrate to form the use solution when the water of dilution is considered to be fairly hard water and the ratio of water of dilution to the concentrate is fairly high.

The chelant component, when included in the cleaning composition concentrate, can be provided in an amount of about 0.1 wt. % to about 30 wt. %. When the detergent composition concentrate is provided as a liquid, the chelant component can be provided in an amount of about 0.1 wt. % to about 20 wt. %, and about 0.5 wt. % to about 10 wt. %. When the detergent composition concentrate is provided as a solid, the chelant component can be provided at a concentration of about 0.5 wt. % to about 30 wt. %, and about 1 wt. % to about 20 wt. %.

The Water Component

The concentrate can be provided in the form of a liquid, a gel, or a solid. The concentrate can be formulated without any water or can be provided with a relatively small amount of water in order to reduce the expense of transporting the concentrate. When the concentrate is provided as a liquid, it may be desirable to provide it in a flowable form so that it can be pumped or aspirated. It has been found that it is generally difficult to accurately pump a small amount of a liquid. It is generally more effective to pump a larger amount of a liquid. Accordingly, although it is desirable to provide the concentrate with as little as possible in order to reduce transportation costs, it is also desirable to provide a concentrate that can be dispensed accurately. As a result, a concentrate according to the invention, when it includes water, it can include water in an amount of about 0.1 wt. % to about 99 wt. %, about 30 wt. % to about 90 wt. %, and about 60 wt. % to about 89 wt. %.

It should be understood that the water provided as part of the concentrate can be relatively free of hardness. The water can be deionized to remove a portion of the dissolved solids. The concentrate can be diluted with water available at the locale or site of dilution and that water may contain varying levels of hardness depending upon the locale. Although deionized is preferred for formulating the concentrate, the concentrate can be formulated with water that has not been deionized. That is, the concentrate can be formulated with water that includes dissolved solids, and can be formulated with water that can be characterized as hard water.

Service water available from various municipalities can have varying levels of hardness. It is generally understood that the calcium, magnesium, iron, manganese, or other polyvalent metal cations that may be present can cause precipitation of the anionic surfactant. In general, because of the expected large level of dilution of the concentrate to provide a use solution, it is expected that service water from certain municipalities will have a greater impact on the potential for anionic surfactant precipitation than the water from other municipalities. As a result, it is desirable to provide a concentrate that can handle the hardness levels found in the service water of various municipalities.

When the hardness level is considered to be fairly high, it is difficult to handle the hardness using traditional builders because of the large amount of water of dilution used to dilute the concentrate to form the use solution. Because builders have a tendency to act in a molar relationship with cationic salts, it is expected that the concentrate would require a large amount of a builder component if the builder component was the only component responsible for handling the hardness. Accordingly, even if it is possible to incorporate an amount of builder into the concentrate to prevent precipitation of the anionic surfactant component, it would be desirable to provide a concentrate that did not require so much builder to handle the hardness levels found in the service water of various municipalities.

The water of dilution that can be used to dilute the concentrate can be characterized as hard water when it includes at least 1 grain hardness. It is expected that the water of dilution can include at least 5 grains hardness, at least 10 grains hardness, or at least 20 grains hardness.

The concentrate can be diluted with the water of dilution in order to provide a use solution having a desired level of detersive properties. If the concentrate contains a large amount of water, it is expected that the concentrate can be diluted with the water of dilution at a weight ratio of at least about 1:1 to provide a desired use solution. If the concentrate includes no water or very little water, it is expected that the concentrate can be diluted at a weight ratio of concentrate to water of dilution of up to about 1:1000 in order to provide a desired use solution. It is expected that the weight ratio of concentrate to water of dilution can be about 1:2 to about 1:100, about 1:5 to about 1:50, about 1:10 to about 1:40, and about 1:15 to about 1:30. In certain preferred applications, the concentrate can be diluted at a weight ratio of concentrate to water of dilution of about 1:16 to about 1:20 to provide a consumer glass cleaner, and at a weight ratio of about 1:15 to about 1:30 to provide a glass cleaning composition for vehicle washing facilities.

Other Components

Optional ingredients which can be included in the cleaning composition of the invention include hydrotropes, processing aids, corrosion inhibitors, dyes, fillers, optical brighteners, germicides, pH adjusting agents (monoethanolamine, sodium carbonate, sodium hydroxide, hydrochloric acid, phosphoric acid, et cetera), bleaches, bleach activators, fragrances, viscosity modifiers, solidification agents, and the like.

It can be desirable to provide the ready to use composition with a relatively neutral or alkaline pH. In many situations, it is believed that the presence of hard water as water of dilution will cause the ready to use composition to exhibit a neutral or alkaline pH. In order to ensure a relatively neutral or alkaline pH, a buffer can be incorporated into the concentrate. In general, the amount of buffer should be sufficient to provide the use solution with a pH in the range of about 6 to 14, and preferably between about 7 and 10.

The buffer can include an alkalinity source. Exemplary alkaline buffering agents include alkanolamines. An exemplary alkanolamine is beta-aminoalkanol and 2-amino-2-methyl-1-propanol(AMP).

Preferred alkanolamines are beta-aminoalkanol compounds. They serve primarily as solvents when the pH is about 8.5, and especially above about 9.0. They also can provide alkaline buffering capacity during use. Exemplary beta-aminoalkanols are 2-amino-1-butanol; 2-amino-2-methyl-1-propanol; and mixtures thereof. The most preferred beta-aminoalkanol is 2-amino-2-methyl-1-propanol since it has the lowest molecular weight of any beta-aminoalkanol which has the amine group attached to a tertiary carbon atom. The beta-aminoalkanols preferably have boiling points below about 175° C. Preferably, the boiling point is within about 5° C. of 165° C.

Beta-aminoalkanols, and especially monoethanolamine and the preferred 2-amino-2-methyl-1-propanol, are surprisingly volatile from cleaned surfaces considering their relatively high molecular weights. It is found that levels below an equivalent of about 0.010% 2-amino-2-methyl-1-propanol are insufficient to provide the necessary buffering capacity necessary to maintain the pH of the formulations within a narrow range.

Other suitable alkalinity agents that can also be used, but less desirably, include alkali metal hydroxides, i.e., sodium, potassium, etc., and carbonates or sodium bicarbonates. Water-soluble alkali metal carbonate and/or bicarbonate salts, such as sodium bicarbonate, potassium bicarbonate, potassium carbonate, cesium carbonate, sodium carbonate, and mixtures thereof, can be added to the composition of the present invention in order to improve the filming/streaking when the product is wiped dry on the surface, as is typically done in glass cleaning. Preferred salts are sodium carbonate, potassium carbonate, sodium bicarbonate, potassium bicarbonate, their respective hydrates, and mixtures thereof.

Contrary to the teachings of U.S. Pat. No. 6,420,326, the concentrate can include a buffering capacity greater than the equivalent of 0.050 wt. % 2-amino-2-methyl-1-propanol without experiencing deleterious streaking as a glass cleaner composition. In addition, the concentrate can include a buffering capacity greater than the equivalent of 0.070 wt. % of 2-amino-2-methyl-1-propanol, and greater than the equivalent of 0.1 wt. % of 2-amino-2-methyl-1-propanol.

The concentrate can include a solidification agent to provide the concentrate in a solidified form such as a pellet, block, or tablet. Exemplary solidification aids include polyethylene, polypropylene glycol, urea, and surfactants that are solid at room temperature.

The ready to use composition and/or the use solution can be foamed during application onto a surface. In the case of a glass cleaner, a foam is generally desirable to provide the composition additional hang time. That is, it is generally desirable to allow the cleaning composition to remain in place on a surface that may be vertical until a user has the opportunity to wipe the cleaner on the surface to provide cleaning. It is believed the cleaning composition can be foamed without the need for certain types of foaming agents such as thickeners. In fact, it is believed that certain thickeners may have an adverse affect on cleaning when used to clean a glass surface if the thickener has a tendency to cause smearing, streaking, or leave a film on the glass surface. Accordingly, thickeners can be excluded from the composition according to the invention. Specific types of thickeners that can be excluded include those thickeners that provide a thickening effect by increasing the viscosity by at least 50 cP. When used as a window cleaner, the cleaning composition can be wiped away, without a water rinse, to provide a streak free glass surface.

An exemplary liquid concentrate for forming a ready to use composition for cleaning a hard surface is provided in Table 1.

TABLE 1

| Component | Wt. % | Wt. % |
|---|---|---|
| surfactant | 0.05-20 | 0.1-10 |
| dispersant | 0.01-10 | 0.1-5 |
| sheeting agent | 0.001-15 | 0.05-10 |
| chelant | 0.1-20 | 0.5-10 |
| humectant | 0.001-15 | 0.05-10 |

An exemplary solid concentrate for forming a ready to use composition for cleaning a hard surface is provided in Table 2.

TABLE 2

| Component | Wt. % | Wt. % |
|---|---|---|
| surfactant | 10-90 | 20-80 |
| dispersant | 1-20 | 2-15 |
| sheeting agent | 0.01-20 | 0.1-15 |
| chelant | 0.5-30 | 1-20 |
| humectant | 0.01-20 | 0.1-15 |

The concentrate can be provided so that it is substantially free of volatile organic compounds. Being substantially free of volatile organic compounds means that if any volatile organic compounds are present, they are present in amounts insufficient to aid in drying a surface. Many hard surface cleaners include volatile organic compounds to aid in water removal as a result of an azeotroping effect. If a volatile organic compound is present in the concentrate according to the invention, it can be provided in an amount that does not aid in drying when the concentrate is diluted to a use composition and the use composition is used on a hard surface. In general, when the hard surface cleaner does not include an amount of a volatile organic compound sufficient to aid in drying, the cleaning composition can be referred to as substantially free of volatile organic compounds. By way of example, a concentrate can be substantially free of volatile organic compounds if the concentrate contains less than 0.1 wt. % volatile organic compound. Preferably, the concentrate can contain less than about 0.05 wt. % volatile organic compound, and can contain zero amount volatile organic compound. Volatile organic compounds include those compounds that exhibit a vapor pressure of greater than about 0.1 mm Hg at 20° C. Non-volatile or low volatile organic compounds can be defined as those exhibiting a vapor pressure of less than about 0.1 mm Hg at 20° C. Various components that are considered non-volatile or low volatile organic compounds can be included in the concentrate, if desired.

Exemplary volatile organic compounds that can be excluded from the cleaning composition include ethanol, isopropanol, acetone, methylethyl ketone, dichloroethane, methylene chloride, perchloroethylene, 1-decene, and 1-dodecene.

Certain glycol ethers such as those having the formula $R^1O—(R^2O—)_mH$ wherein each $R^1$ is an alkyl group which contains from about 1 to about 8 carbon atoms, each $R^2$ is either ethylene or propylene, and $m^1$ is a number from 1 to about 3 can be considered volatile or non-volatile. The volatile glycol ethers can be excluded and the non-volatile glycol etheres can be included. Exemplary glycol ethers include monopropyleneglycolmonopropyl ether, dipropyleneglycolmonobutyl ether, monopropyleneglycolmonobutyl ether, ethyleneglycolmonohexyl ether, ethyleneglycolmonobutyl ether, diethyleneglycolmonohexyl ether, monoethyleneglycolmonohexyl ether, monoethyleneglycolmonobutyl ether, and mixtures thereof. Additional organic compounds that can be excluded or included depending on whether or not they are volatile or non-volatile include solvents such as pine oil, orange terpene, benzyl alcohol, n-hexanol, phthalic acid esters of $C_{1-4}$ alcohols, butoxy propanol, Butyl Carbitol® and 1 (2-n-butoxy-1-methylethoxy)propane-2-ol (also called butoxy propoxy propanol or dipropylene glycol monobutyl ether), hexyl diglycol (Hexyl Carbitol®), butyl triglycol, and diols such as 2,2,4-trimethyl-1,3-pentanediol.

The cleaning composition can be prepared at a first location and shipped or transported to a second location for dilution. The second location can be provided with a water source that includes hardness. An exemplary type of second location is a commercial store where the concentrate is diluted, packaged, and distributed to customers. The second location can be another facility that provides for further dilution and distribution of the product. In addition, the second location can be a job site, such as, a hotel or other building requiring janitorial services. In addition, it should be understood that there can be multiple locations where dilution occurs. For example, an intermediary dilution can occur at the second location, and the final dilution to a use solution can be provided by the consumer at about the time the detergent composition is used for cleaning.

The detergent composition, when provided as a use solution, can be applied to a surface or substrate for cleaning in a variety of forms. Exemplary forms include as a spray and as a foam. In the case of a glass cleaner, it may be desirable to provide the use solution as a foam in order to hinder running of the use solution down a vertical window. It is believed that a pump foamer can be used to create a foam for application to a surface or substrate without the need for propellants or other blowing agents. The foam can be characterized as a mechanically generated foam rather than a chemically generated foam when a hand or finger pump is used to create the foam. An exemplary foaming head that can be used with the detergent composition can be obtained from Zeller in Germany.

The cleaning composition can be used as a glass cleaner for cleaning glass surfaces including windows and mirrors. In addition, it is believed that the cleaning composition can be used as a hard surface cleaner, a bathroom cleaner, a dishwash detergent, a floor cleaner, a countertop cleaner, and a metal cleaner. In addition, it is believed that the detergent composition can be used in a car wash facility for cleaning glass, for washing the car, for prewash applications, and for metal brightening. It should be understood that the cleaning composition can be applied directly to a surface such as a glass surface and wiped away to provide a streak free surface. In addition, the detergent composition can be rinsed from a surface with water.

The above specification provides a basis for understanding the metes and bounds of the invention. The following examples and test data provide an understanding of certain specific embodiments of the invention. The examples are not meant to limit the scope of the invention that has been set forth in the foregoing description. Variations within the concepts of the invention are apparent to those skilled in the art.

Example 1

Liquid Ready-To-Use Zero VOC Glass Cleaner

The composition identified in Table 3 was prepared and sprayed onto a window soiled with greasy fingerprints. All fingerprints were easily removed without any streaking. About 15-30 seconds after the glass had been wiped clean, residual liquid visibly sheeted out and disappeared from sight.

TABLE 3

| Liquid Ready-To-Use Zero VOC Glass Cleaner | |
|---|---|
| Component | Amount (wt. %) |
| sodium lauryl sulfate | 4% |
| maleic anhydride/olefin copolymer[1] | 0.7% |
| polyoxyethylene - polyoxypropylene block copolymer[2] | 0.35% |
| water | 94.95% |

[1]Acusol 460ND available from Rohm & Haas
[2]Pluronic N3 is available from BASF.

Example 2

Powdered Zero VOC Glass Cleaner

The composition identified in Table 4 was prepared as a powder. A 1:20 dilution of the powder in hard tap water was used to clean fingerprints off a window without any streaking. About 15-30 seconds after the glass had been wiped clean, residual liquid visibly sheeted out and disappeared from sight.

TABLE 4

| Powdered Zero VOC Glass Cleaner | |
|---|---|
| Component | Amount (wt. %) |
| sodium lauryl sulfate | 79.78% |
| maleic anhydride/olefin copolymer[1] | 13.31% |
| polyoxyethylene - polyoxypropylene block copolymer[2] | 6.91% |

[1]Acusol 460ND available from Rohm & Haas
[2]Pluronic N3 is available from BASF.

Example 3

Compressed Solid Zero VOC Glass Cleaner

The composition identified in Table 5 was prepared as a powder and then compressed into a solid. A 1:20 dilution of the solid in hard tap water was used to clean fingerprints off a window without any streaking. About 15-30 seconds after the glass had been wiped clean, residual liquid visibly sheeted out and disappeared from sight.

TABLE 5

| Solid Glass Cleaner | |
|---|---|
| Component | Amount (wt. %) |
| sodium lauryl sulfate | 71% |
| maleic anhydride/olefin copolymer[1] | 11.85% |
| polyoxyethylene - polyoxypropylene block copolymer[2] | 6.15% |
| water | 11% |

[1]Acusol 460ND available from Rohm & Haas
[2]Pluronic N3 is available from BASF.

The above specification, examples and data provide a complete description of the manufacture and use of the composition of the invention. Since many embodiments of the invention can be made without departing from the spirit and scope of the invention, the invention resides in the claims hereinafter appended.

We claim:

1. A cleaning composition concentrate consisting of:
(a) about 0.05 wt. % to about 90 wt. % of a surfactant component,
(b) about 0.01 wt. % to about 20 wt. % of a maleic anhydride/olefin co-polymer dispersant component,
(c) about 0.001 wt. % to about 15 wt. % of a sheeting agent component consisting of EOPO block copolymer,
(d) about 0.001 wt. % to about 20 wt. % of a humectant,
(e) less than about 0.1 wt. % volatile organic compound exhibiting a vapor pressure of less than 0.1 mm Hg at 20° C.,
(f) about 0.1 wt. % to about 99 wt. % of water, and
(g) optionally, about 0.01 wt. % to about 30 wt. % of a chelant.

2. A cleaning composition concentrate according to claim 1, wherein the surfactant component is selected from the group consisting of alkyl aryl sulfonate, secondary alkane sulfonate, alkyl methyl ether sulfonate, alpha olefin sulfonate, alkyl ether sulfate, alkyl sulfate, alcohol sulfate, and mixture thereof.

3. A cleaning composition concentrate according to claim 1, wherein the surfactant component is selected from the group consisting of alcohol alkoxylates, alkyl alkylphenol alkoxylates, alkyl amides, alkyl esters, alkyl polyglycosides, alkyl amines, and mixtures thereof.

4. A cleaning composition concentrate according to claim 1, wherein the surfactant component is selected from the group consisting of amine oxides, betaines, betaine derivatives, sultaines, sultaine derivatives, amphocarboxylates, and mixtures thereof.

5. A cleaning composition concentrate according to claim 1, wherein the surfactant component is selected from the group consisting of quaternary ammonium compounds, salts of amines, quaternary phosphonium compounds, quaternary sulfonium compounds, and mixtures thereof.

6. A cleaning composition concentrate according to claim 1, wherein the water is deionized water.

7. A cleaning composition concentrate according to claim 1, wherein the composition is provided in the form of a liquid, and wherein the surfactant component is present in an amount of about 0.05 wt. % to about 20 wt. %, the dispersant component is present in an amount of about 0.01 wt. % to about 10 wt. %, and the sheeting agent component is present in an amount of about 0.001 wt % to about 15 wt.

8. A cleaning composition concentrate according to claim 1, wherein the concentrate is in the form of a liquid or gel.

9. A cleaning composition concentrate according to claim 8, wherein the cleaning composition concentrate is provided as a single dose having a size of about 5 g to about 60 g.

10. A cleaning composition concentrate according to claim 8, wherein the liquid or gel is provided on a substrate comprising at least one of a non-woven fabric, a woven fabric, or a knitted fabric.

11. A cleaning composition concentrate according to claim 1, wherein the composition is provided in the form of a solid, and wherein the surfactant component is present in an amount of about 10 wt. % to about 90 wt. %, the dispersant component is present in an amount of about 1 wt. % to about 20 wt. %, and the sheeting agent component is present in an amount of about 0.01 wt % to about 20 wt.

12. A cleaning composition concentrate according to claim 11, wherein the cleaning composition concentrate is provided as a powder, granule, tablet, pellet, or block.

13. A cleaning composition concentrate according to claim 11, wherein the cleaning composition concentrate is provided as a single dose having a size of about 0.1 g to about 25 g.

14. A cleaning composition concentrate according to claim 13, wherein the single dose is provided in a container, wherein the container comprises a water soluble film.

15. A cleaning composition concentrate according to claim 13, wherein the solid is provided on a substrate.

16. A cleaning composition concentrate according to claim 15, wherein the substrate comprises at least one of a non-woven fabric, a woven fabric, or a knitted fabric.

17. A cleaning composition concentrate according to claim 1, wherein the humectant is selected from the group consisting of glycerine, glycols, sugars, sorbitol, alkylpolyglycosides, polybetaine polysiloxanes, and mixtures thereof.

18. A cleaning composition concentrate according to claim 1, wherein the chelant is present in the cleaning composition concentrate.

19. A cleaning composition concentrate according to claim 18, wherein the chelant is an inorganic chelating agent or organic chelating agents.

20. A method for preparing a cleaning composition comprising:

mixing a cleaning composition concentrate according to claim 1 and water of dilution at a weight ratio of the cleaning composition concentrate to the water of dilution of at least about 1:1 to provide a use composition.

21. A method according to claim 20, wherein the ratio of dilution is about 1:2 to about 1:100.

* * * * *